US007549954B2

(12) United States Patent
Blythe

(10) Patent No.: US 7,549,954 B2
(45) Date of Patent: Jun. 23, 2009

(54) SLIDER FOR RECLOSABLE FASTENER

(75) Inventor: James S. Blythe, Libertyville, IL (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

(21) Appl. No.: 11/848,792

(22) Filed: Aug. 31, 2007

(65) Prior Publication Data

US 2007/0289109 A1 Dec. 20, 2007

Related U.S. Application Data

(62) Division of application No. 11/002,848, filed on Dec. 2, 2004, now Pat. No. 7,263,748.

(60) Provisional application No. 60/526,304, filed on Dec. 2, 2003.

(51) Int. Cl.
*B31B 1/90* (2006.01)

(52) U.S. Cl. ..... 493/215; 493/212; 493/213; 493/214; 493/963

(58) Field of Classification Search ..... 493/210, 493/211–215, 963
See application file for complete search history.

(56) References Cited

U.S. PATENT DOCUMENTS 5,010,627 A * 4/1991 Herrington et al. ..... 24/400
5,063,644 A * 11/1991 Herrington et al. ..... 24/400
5,067,208 A 11/1991 Herrington, Jr., et al.
5,070,583 A * 12/1991 Herrington ..... 24/400
5,448,808 A 9/1995 Gross
5,722,128 A 3/1998 Toney et al.
5,867,875 A 2/1999 Beck et al.
5,871,281 A 2/1999 Stolmeier et al.
5,896,627 A 4/1999 Cappel et al.
6,199,256 B1 * 3/2001 Revnew et al. ..... 29/408
6,287,001 B1 9/2001 Buchman
6,293,701 B1 * 9/2001 Tomic ..... 383/64
6,364,530 B1 4/2002 Buchman
6,739,755 B2 5/2004 Schreiter
6,846,108 B2 1/2005 Buchman
6,874,205 B1 4/2005 Savicki
7,263,748 B2 9/2007 Blythe

* cited by examiner

*Primary Examiner*—Christopher Harmon
(74) *Attorney, Agent, or Firm*—Baker Botts LLP

(57) ABSTRACT

A foldable plastic slider for straddling relation with a plastic fastener includes first and second profiles. The straddling slider is adapted to close or open the fastener by movement therealong. The slider comprises a transverse support member, first and second legs, first and second separating fingers, and first and second wings. The transverse support member includes first and second opposing sides, an interior surface, and an outer surface. The first and second legs depend from the respective first and second opposing sides of the support member. The first separating finger extends from the interior surface of the support member. The first separating finger is adapted to open the first and second profiles. The second separating finger extends from the interior surface of the support member. The first and second wings are hingedly attached to the respective first and second opposing sides. The first and second wings have respective first and second openings for receiving the respective first and second legs. The first and second wings have respective first and second cross pieces. Each of the cross pieces includes a main body member and a latch. The first and second wings are folded relative to the support member and each of the latches engages one of the respective legs to install the slider on the fastener.

20 Claims, 7 Drawing Sheets

SLIDER FOR RECLOSABLE FASTENER

REFERENCE TO RELATED APPLICATION

This application is a Divisional of U.S. patent application Ser. No. 11/002,848 filed on Dec. 2, 2004 now U.S. Pat. No. 7,263,748, which claims priority to Provisional to U.S. Patent Application Ser. No. 60/526,304 filed on Dec. 2, 2003, the contents of which are expressly incorporated by reference herein in their entirety.

FIELD OF THE INVENTION

The present invention relates generally to sliders for reclosable fasteners, and, more particularly, sliders that assist in opening and closing polymeric bags.

BACKGROUND OF THE INVENTION

Polymeric bags are popular household items that are used in a variety of applications including storage of food. The addition of reclosable fasteners or zippers to these bags has further enhanced their utility and the addition of a slider has made the fasteners easier to open and close. The fasteners include complementary first and second profiles that engage each other to close the bag.

One problem encountered in installing the slider to the fastener is distortion of the first and second profiles of the fastener. The profiles may be distorted when the slider is placed onto the fastener. More specifically, the profiles may be distorted from internal shoulders of the slider that partially form a cavity of the slider. To assist in preventing or inhibiting distortion to the profiles when inserting the slider onto the fastener, the slider may be constructed to have improved flexibility. These flexible sliders, however, do not generally have a desirable stiffness to remain on the fastener during normal use by a consumer.

A need therefore exists for an improved slider that can be inserted over the profiles of the fastener with little or no distortion, while providing a desirable stiffness to remain on the fastener during normal use.

SUMMARY OF THE INVENTION

According to one embodiment, a foldable plastic slider for straddling relation with a plastic fastener includes first and second profiles. The straddling slider is adapted to close or open the fastener by movement therealong. The slider comprises a transverse support member, first and second legs, first and second separating fingers, and first and second wings.

The transverse support member includes first and second opposing sides, an interior surface, and an outer surface. The first and second legs depend from the respective first and second opposing sides of the support member. The first separating finger extends from the interior surface of the support member. The first separating finger is adapted to open the first and second profiles. The second separating finger extends from the interior surface of the support member. The first and second wings are hingedly attached to the respective first and second opposing sides. The first and second wings have respective first and second openings for receiving the respective first and second legs. The first and second wings have respective first and second cross pieces. Each of the cross pieces includes a main body member and a latch. The first and second wings are folded relative to the support member and each of the latches engages one of the respective legs to install the slider on the fastener.

According to one aspect, at least one of the first and second separating fingers includes a rounded surface.

According to another aspect, at least one of the first and second separating fingers can include at least one of a generally half-moon shape, a circular shape, an elongated oval shape, and an elliptical shape.

According to another aspect, each of the first and second legs has gripper ribs formed by tactilely enhanced surfaces to assist in grasping the slider.

According to another aspect, the outer surface of the transverse support member is substantially free of coring.

According to another aspect, each of the latches is generally centered on the respective main body member.

According to another aspect, each of said legs has an edge with a shoulder for engaging the respective latch.

According to another embodiment, a foldable plastic slider for straddling relation with a plastic fastener includes first and second profiles. The straddling slider is adapted to close or open the fastener by movement therealong. The slider comprises a transverse support member, first and second legs, a separating finger, and first and second wings.

The transverse support member includes first and second opposing sides, an interior surface, and an outer surface. The first and second legs depend from the respective first and second opposing sides of the support member. The separating finger extends from the interior surface of the support member. The separating finger is adapted to open the first and second profiles. The first and second wings are hingedly attached to the respective first and second opposing sides. The first and second wings have respective first and second openings for receiving the respective first and second legs. The first and second wings have respective first and second cross pieces. Each of the cross pieces includes a main body member and a latch. Each of the latches substantially extends across the full length of the respective legs. The first and second wings are folded relative to the support member and each of the latches engages one of the respective legs to install the slider on the fastener.

According to a further embodiment, a foldable plastic slider for straddling relation with a plastic fastener includes first and second profiles. The straddling slider is adapted to close or open the fastener by movement therealong. The slider comprises a transverse support member, first and second legs, a separating finger, and first and second wings.

The transverse support member includes first and second opposing sides, an interior surface, and an outer surface. The first and second legs depend from the respective first and second opposing sides of the support member. The separating finger extends from the interior surface of the support member. The separating finger is adapted to open the first and second profiles. The first and second wings are hingedly attached to the respective first and second opposing sides. The first and second wings have respective first and second openings for receiving the respective first and second legs. The first and second wings have respective first and second cross pieces. Each of the cross pieces includes a cored-out main body member and a latch. Each of the cored-out main body members has a plurality of cored-out regions on an interior of the respective cross piece such that the plurality of cored-out regions are at least partially hidden when the slider is installed on a fastener. The plurality of cored-out regions can form a plurality of triangular regions or a truss. The first and second wings are folded relative to the support member and each of the latches engages one of the respective legs to install the slider on the fastener.

According to yet another embodiment, a foldable plastic slider for straddling relation with a plastic fastener includes first and second profiles. The straddling slider is adapted to close or open the fastener by movement therealong. The slider comprises a transverse support member, first and second legs, a separating finger, and first and second wings.

The transverse support member includes first and second opposing sides, an interior surface, and an outer surface. The first and second legs depend from the respective first and second opposing sides of the support member. The separating finger extends from the interior surface of the support member. The separating finger is adapted to open the first and second profiles. The first and second wings are hingedly attached to the respective first and second opposing sides. The first and second wings have respective first and second openings for receiving the respective first and second legs. The first and second wings have respective first and second cross pieces. Each of the cross pieces includes a main body member and a latch. The first and second wings are folded relative to the support member and each of the latches engages one of the respective legs to install the slider on the fastener. The first and second legs form respective wing closing stops so as to prevent or inhibit the first and second wings from moving past a latched hinge rotational point formed after each of the latches engages one of the respective legs.

According to yet another embodiment, a foldable plastic slider for straddling relation with a plastic fastener includes first and second profiles. The straddling slider is adapted to close or open the fastener by movement therealong. The slider comprises a transverse support member, first and second legs, a separating finger, and first and second wings.

The transverse support member includes first and second opposing sides, an interior surface, and an outer surface. The first and second legs depend from the respective first and second opposing sides of the support member. The separating finger extends from the interior surface of the support member. The separating finger is adapted to open the first and second profiles. The first and second wings are hingedly attached to the respective first and second opposing sides. The first and second wings have respective first and second openings for receiving the respective first and second legs. The first and second wings have respective first and second cross pieces. Each of the cross pieces includes a main body member and a latch. The first and second wings are folded relative to the support member and each of the latches engages one of the respective legs to install the slider on the fastener. The support member further includes a molded rear window with an outer surface that is located adjacent to the first and second legs. The outer surface of the molded rear window is adapted to contact the first and second legs after the slider is installed on the fastener.

According to one embodiment, a reclosable plastic bag comprises opposing body panels attached to each other along a pair of opposing sides, a bottom bridging the sides, a mouth formed opposite the bottom, a reclosable fastener extending along the mouth, and a plastic slider. The fastener includes a first track with a first profile and a second track with a second profile. The first and second profiles are releasably engageable to each other.

The plastic slider is slidably mounted to the fastener. The slider comprises a transverse support member, first and second legs, first and second separating fingers, and first and second wings. The transverse support member includes first and second opposing sides, an interior surface, and an outer surface. The first and second legs depend from the respective first and second opposing sides of the support member. The first separating finger extends from the interior surface of the support member. The first separating finger is adapted to open the first and second profiles. The second separating finger extends from the interior surface of the support member. The first and second wings are hingedly attached to the respective first and second opposing sides. The first and second wings have respective first and second openings for receiving the respective first and second legs. The first and second wings have respective first and second cross pieces. Each of the cross pieces includes a main body member and a latch. The first and second wings are folded relative to the support member and each of the latches engages one of the respective legs to install the slider on the fastener.

According to another embodiment, a reclosable plastic bag comprises opposing body panels attached to each other along a pair of opposing sides, a bottom bridging the sides, a mouth formed opposite the bottom, a reclosable fastener extending along the mouth, and a plastic slider. The fastener includes a first track with a first profile and a second track with a second profile. The first and second profiles are releasably engageable to each other.

The plastic slider is slidably mounted to the fastener. The slider comprises a transverse support member, first and second legs, a separating finger, and first and second wings. The transverse support member includes first and second opposing sides, an interior surface, and an outer surface. The first and second legs depend from the respective first and second opposing sides of the support member. The separating finger extends from the interior surface of the support member. The separating finger is adapted to open the first and second profiles. The first and second wings are hingedly attached to the respective first and second opposing sides. The first and second wings have respective first and second openings for receiving the respective first and second legs. The first and second wings have respective first and second cross pieces. Each of the cross pieces includes a main body member and a latch. Each of the latches substantially extends across the full length of the respective legs. The first and second wings are folded relative to the support member and each of the latches engages one of the respective legs to install the slider on the fastener.

According to a further embodiment, a reclosable plastic bag comprises opposing body panels attached to each other along a pair of opposing sides, a bottom bridging the sides, a mouth formed opposite the bottom, a reclosable fastener extending along the mouth, and a plastic slider. The fastener includes a first track with a first profile and a second track with a second profile. The first and second profiles are releasably engageable to each other.

The plastic slider is slidably mounted to the fastener. The slider comprises a transverse support member, first and second legs, a separating finger, and first and second wings. The transverse support member includes first and second opposing sides, an interior surface, and an outer surface. The first and second legs depend from the respective first and second opposing sides of the support member. The separating finger extends from the interior surface of the support member. The separating finger is adapted to open the first and second profiles. The first and second wings are hingedly attached to the respective first and second opposing sides. The first and second wings have respective first and second openings for receiving the respective first and second legs. The first and second wings have respective first and second cross pieces. Each of the cross pieces includes a cored-out main body member and a latch. Each of the cored-out main body members is in the form of a truss. The first and second wings are folded relative to the support member and each of the latches engages one of the respective legs to install the slider on the fastener.

According to yet another embodiment, a reclosable plastic bag comprises opposing body panels attached to each other along a pair of opposing sides, a bottom bridging the sides, a mouth formed opposite the bottom, a reclosable fastener extending along the mouth, and a plastic slider. The fastener includes a first track with a first profile and a second track with a second profile. The first and second profiles are releasably engageable to each other.

The plastic slider is slidably mounted to the fastener. The slider comprises a transverse support member, first and second legs, a separating finger, and first and second wings. The transverse support member includes first and second opposing sides, an interior surface, and an outer surface. The first and second legs depend from the respective first and second opposing sides of the support member. The separating finger extends from the interior surface of the support member. The separating finger is adapted to open the first and second profiles. The first and second wings are hingedly attached to the respective first and second opposing sides. The first and second wings have respective first and second openings for receiving the respective first and second legs. The first and second wings have respective first and second cross pieces. Each of the cross pieces includes a main body member and a latch. The first and second wings are folded relative to the support member and each of the latches engages one of the respective legs to install the slider on the fastener. The first and second legs form respective wing closing stops so as to prevent or inhibit the first and second wings from moving past a latched hinge rotational point formed after each of the latches engages one of the respective legs.

According to yet a further embodiment, a reclosable plastic bag comprises opposing body panels attached to each other along a pair of opposing sides, a bottom bridging the sides, a mouth formed opposite the bottom, a reclosable fastener extending along the mouth, and a plastic slider. The fastener includes a first track with a first profile and a second track with a second profile. The first and second profiles are releasably engageable to each other.

The plastic slider is slidably mounted to the fastener. The slider comprises a transverse support member, first and second legs, a separating finger, and first and second wings. The transverse support member includes first and second opposing sides, an interior surface, and an outer surface. The first and second legs depend from the respective first and second opposing sides of the support member. The separating finger extends from the interior surface of the support member. The separating finger is adapted to open the first and second profiles. The first and second wings are hingedly attached to the respective first and second opposing sides. The first and second wings have respective first and second openings for receiving the respective first and second legs. The first and second wings have respective first and second cross pieces. Each of the cross pieces includes a main body member and a latch. The first and second wings are folded relative to the support member and each of the latches engages one of the respective legs to install the slider on the fastener. The support member further includes a molded rear window with an outer surface that is located adjacent to the first and second legs. The outer surface of the molded rear window is adapted to contact the first and second legs after the slider is installed on the fastener.

According to one method, a foldable plastic slider is installed onto a reclosable plastic bag including opposing body panels attached to each other along a pair of opposing sides, a bottom bridging the sides, a mouth formed opposite the bottom, and reclosable fastener extending along the mouth. The fastener includes a first track with a first profile and a second track with a second profile. The first and second profiles are releasably engageable to each other. The plastic slider is slidably mounted to the fastener. The slider comprises a transverse support member, first and second legs, first and second separating fingers, and first and second wings. The transverse support member includes first and second opposing sides, an interior surface, and an outer surface. The first and second legs depend from the respective first and second opposing sides of the support member and having respective first and second shoulders. The first separating finger extends from the interior surface of the support member. The first separating finger is adapted to open the first and second profiles. The second separating finger extends from the interior surface of the support member. The first and second wings are hingedly attached to the respective first and second opposing sides. The first and second wings have respective first and second openings for receiving the respective first and second legs. The first and second wings have respective first and second cross pieces. Each of the cross pieces includes a main body member and a latch.

The transverse support member is placed on the plastic fastener with the first and second separating fingers between the first and second tracks and the first and second depending legs outside the respective first and second tracks such that the respective first and second tracks separate the first and second separating fingers from the respective first and second legs. The first and second wings are rotated downward toward a bottom of the reclosable bag until each of the latches engages one of the respective legs. The first and second wings are pressed until each of the latches snaps into engagement with one of the respective shoulders of the respective leg.

According to another method, a foldable plastic slider is installed onto a reclosable plastic bag including opposing body panels attached to each other along a pair of opposing sides, a bottom bridging the sides, a mouth formed opposite the bottom, and reclosable fastener extending along the mouth. The fastener includes a first track with a first profile and a second track with a second profile. The first and second profiles are releasably engageable to each other. The plastic slider are slidably mounted to the fastener. The slider comprises a transverse support member, first and second legs, a separating finger, and first and second wings. The transverse support member includes first and second opposing sides, an interior surface, and an outer surface. The first and second legs depend from the respective first and second opposing sides of the support member and having respective first and second shoulders. The first separating finger extends from the interior surface of the support member. The first separating finger is adapted to open the first and second profiles. The second separating finger extends from the interior surface of the support member. The first and second wings are hingedly attached to the respective first and second opposing sides. The first and second wings have respective first and second openings for receiving the respective first and second legs, and respective wing closing stops. The first and second wings have respective first and second cross pieces. Each of the cross pieces includes a main body member and a latch.

The transverse support member is placed on the plastic fastener with the separating finger between the first and second tracks and the first and second depending legs outside the respective first and second tracks such that the respective first and second tracks separate the separating finger from the respective first and second legs. The first and second wings are rotated downward toward a bottom of the reclosable bag until each of the latches engages one of the respective legs. The first and second wings are pressed until each of the latches snaps into engagement with one of the respective shoulders of the respective leg. The first and second legs form respective wing closing stops so as to prevent or inhibit the first and second wings from moving past a latched hinge rotational point formed after each of the latches engages one of the respective legs.

Figure 1:
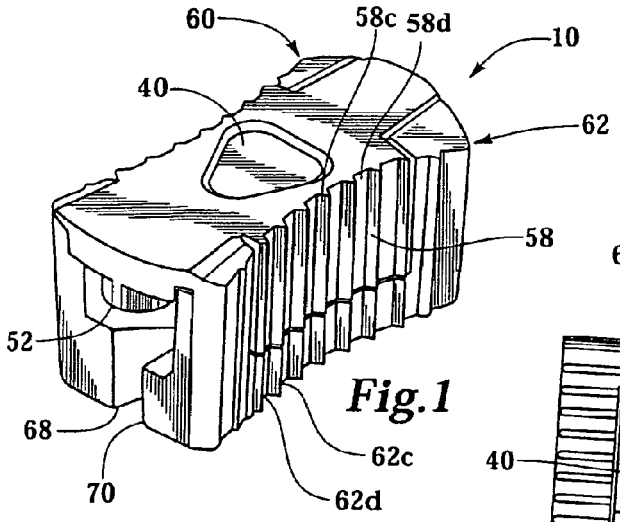
FIG. 1 is an enlarged perspective view of a slider in the closed position according to one embodiment of the present invention.
Figure 2:
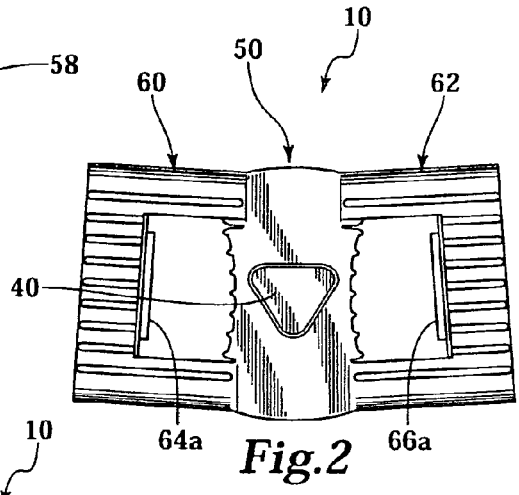
FIG. 2 is a top plan view of the slider of FIG. 1 in the open position.

While the invention is susceptible to various modifications and alternative forms, specific embodiments thereof have been shown by way of example in the drawings and will herein be described in detail. It should be understood, however, that it is not intended to limit the invention to the particular forms disclosed but, on the contrary, the intention is to cover all modifications, equivalents, and alternatives falling within the spirit and scope of the invention as defined by the appended claims.

DETAILED DESCRIPTION OF THE PREFERRED EMBODIMENTS

Referring initially to FIGS. 1-5, there is illustrated a foldable slider 10 according to one embodiment of the present invention. The slider 10 is an inverted generally U-shaped member. The sliders of the present invention may be combined with a fastener or zipper 12 in forming a reclosable polymeric bag 14 (see FIGS. 6-10). The foldable slider 10 in such an embodiment assists in opening the reclosable polymeric bag 14 between a closed position and an open position.

Figure 7:
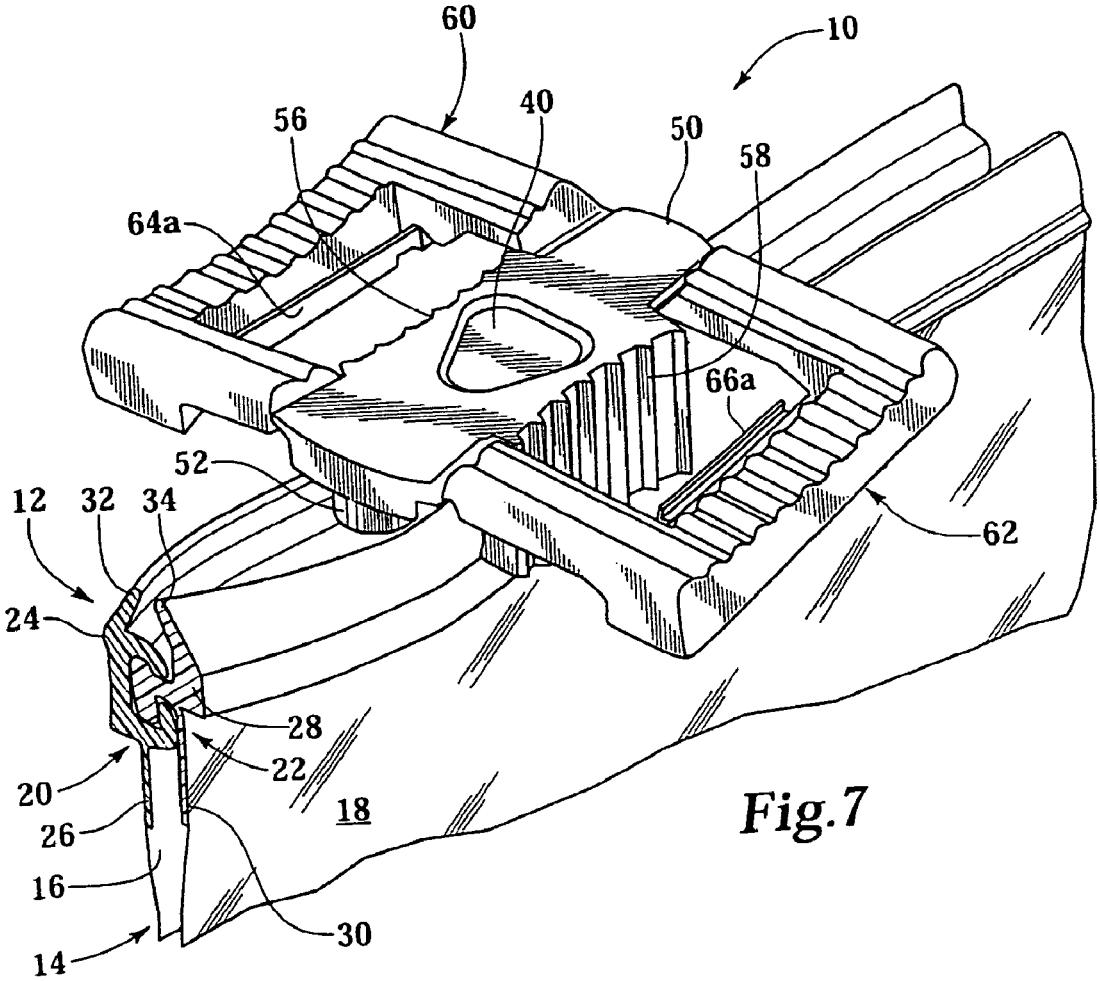
FIGS. 7-9 are a sequence of steps of inserting the slider of FIG. 1 on a fastener.
Figure 8:
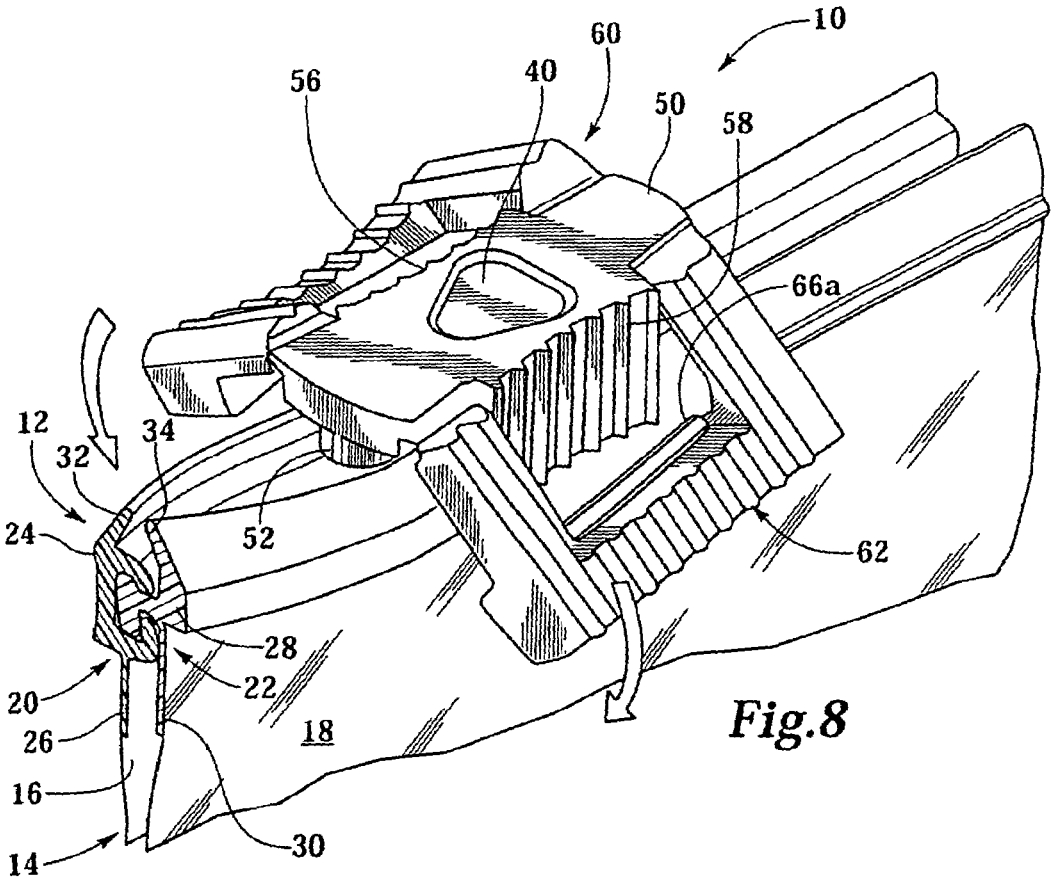
Figure 9:
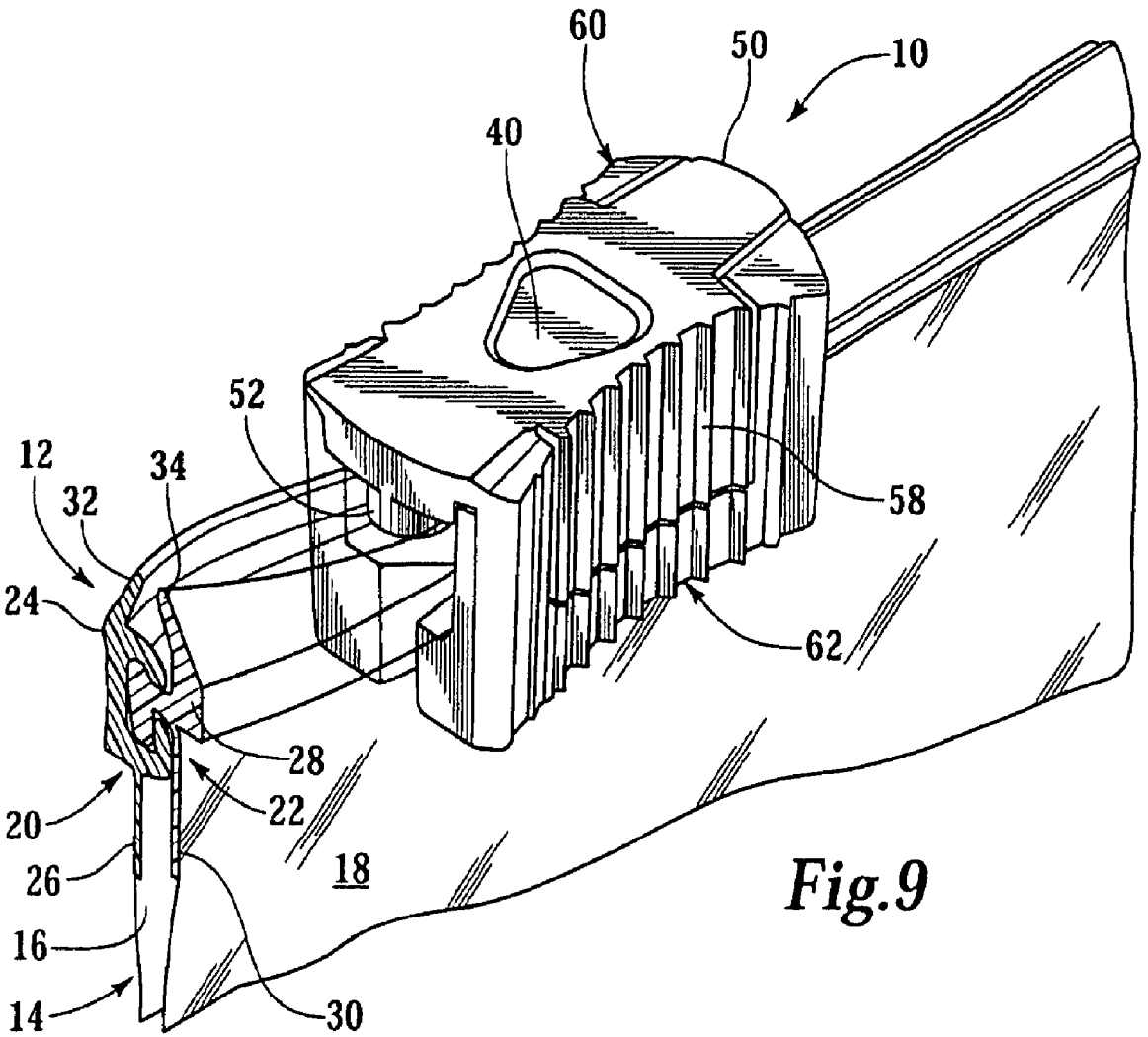
Figure 10:
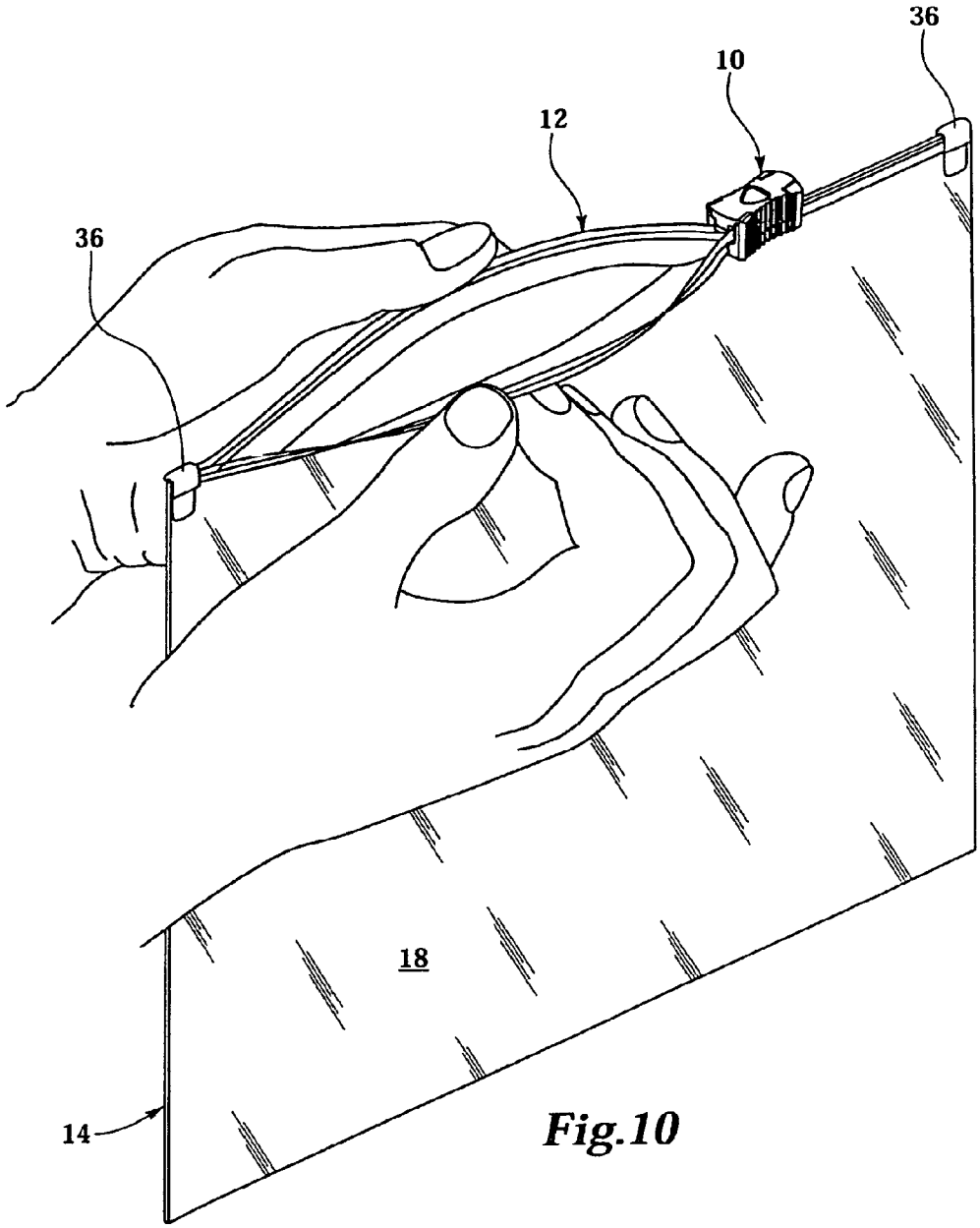
FIG. 10 is a polymeric bag with the slider of FIG. 1.

FIGS. 7-9 depict a mouth portion of the reclosable polymeric bag 14. The polymeric bag 14 comprises first and second opposing body panels 16 and 18 fixedly connected to each other along a pair of sides (not shown) and a bottom (not shown) bridging the pair of sides. The entire bag 14, however, is shown in FIG. 10. The bag may be formed from a single flexible polymeric sheet folded upon itself. Alternatively, the bag may be formed from separate polymeric sheets. In this embodiment, the polymeric bag 14 is provided with the fastener 12 extending along a mouth formed opposite the bottom of the polymeric bag.

The body panels 16 and 18 typically comprise one or more polymeric resins. The body panels 16 and 18 may be comprised of polyolefins including, but not limited to, polyethylene, polypropylene, or combinations thereof.

The fastener 12 includes a first track 20 and a second track 22. The first track 20 includes a first profile 24 and a first depending fin or flange 26 extending downward from the first profile 24. Similarly, the second track 22 includes a second profile 28 and a second depending fin or flange 30 extending downward from the second profile 28. It is not necessary for the tracks 20, 22 to have fins depending therefrom. The first profile 24 includes a top portion 32 and the second profile 28 includes a top portion 34. If the fastener 12 is formed separately from the body panels 16, 18 of the polymeric bag 14, the first and second fins 26, 30 may be thermally fused to inner surfaces of the respective first and second body panels 16, 18. Alternatively, the fastener 12 may be integrally formed with the body panels 16, 18 such that the first track 20 is integrally formed with the first body panel 16 and the second track 22 is integrally formed with the second body panel 18.

The opposite ends of the fastener 12 are typically provided with opposing end termination clips, such as end termination clip 36 of FIG. 10. End termination clips may have various purposes such as (a) preventing or inhibiting the slider for going past the ends of the fastener, (b) interacting with the slider to give a tactile indication of being closed, (c) assisting in inhibiting or preventing leakage from the bag, and (d) holding the fastener together and providing additional strength in resisting stresses to the bag.

Each end clip 36 of FIG. 10 comprises a strap member that wraps over the top of the fastener 12. One end of the strap is provided with a rivet like member that is adapted to penetrate through the bag material and into a cooperating opening at the other end of the end clip 36. The rivet is then deformed so as to create a head locked into the opening.

It is contemplated that other end terminations may be used instead of the above-described end terminations clip 36. For example, an end weld may be formed by heated bars pressed against the end of the fastener, ultrasonic welding, or other ways known in the art.

Figure 6:
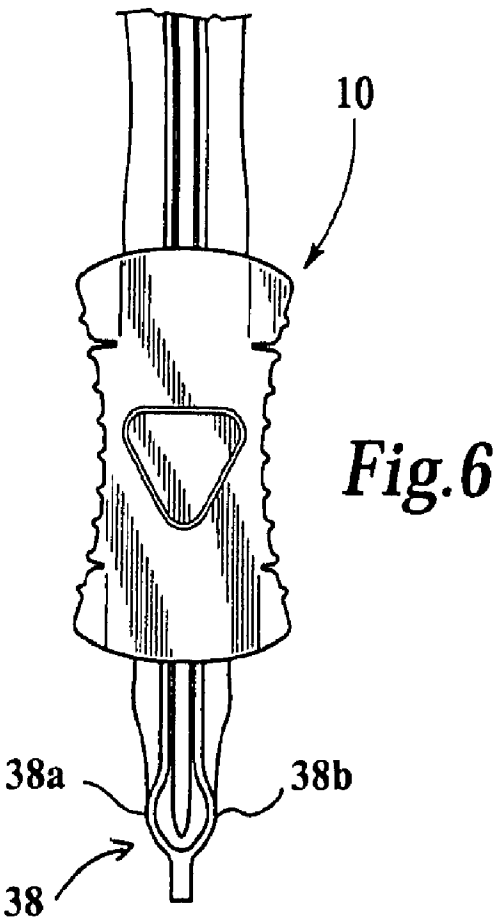
FIG. 6 is a top view of an end termination according to one embodiment.
Figure 5B:
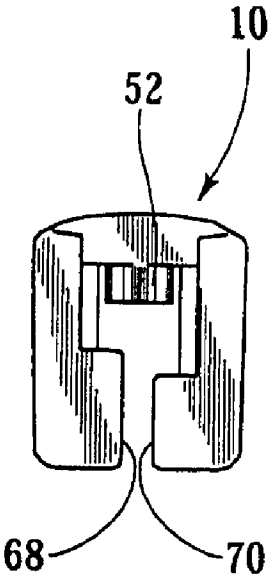
FIG. 5*b* is a second end view of the slider of FIG. 1 in the closed position.
Figure 5A:
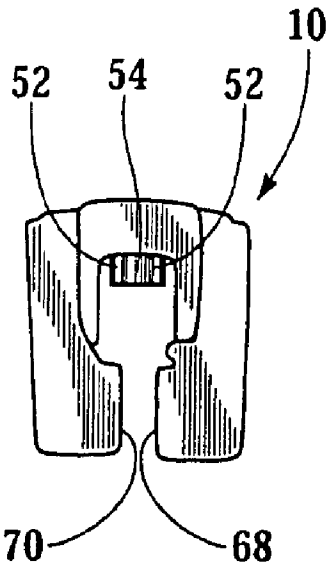
FIG. 5*a* is a first end view of the slider of FIG. 1 in the closed position.

One such example is shown in FIG. 6 where a top view of an end termination 38 is depicted. The end termination 38 can be initially formed from end portions 38*a*, 38*b* of the profiles 24, 28 of the fastener 12 being pressed together by a process involving heat, such as ultrasonic welding. Before and/or during heating, the slider 10 can be disposed on the tracks 20, 22. During and/or after heating of the end portions 38*a*, 38*b* of the profiles 24, 28 (e.g., during cooling of the end portions), separating finger 52 of the slider 10 can be pushed and/or otherwise disposed between the end portions 38*a*, 38*b*, so that the end portions 38*a*, 38*b* cool around the separating finger 52 and cooperatively form an end termination 38 having a shape similar to that of the separating finger 52. After formation of the end termination 38, the separating finger 52 can be positioned substantially within or entirely within the end termination 38 in the closed position of slider 10. The end termination 38 desirably contracts behind the shape of the separating finger 52, thus inhibiting and/or preventing leakage (e.g., of fluids or solid items) from bag 14 in the closed position of the slider 10. The end termination 38 provides a tactile indication, or an audible indication, or both to the user that the slider 10 is in a closed position.

Referring back to FIG. 7, the slider 10 is illustrated in an open position prior to being installed on the fastener 12. FIG. 8 illustrates the slider 10 in the process of being installed on the fastener 12, while FIG. 9 illustrates the slider 10 after being installed on the fastener 12. The slider 10 in its assembled or closed position shown in FIG. 9 forces the first and second profiles 24, 28 into engagement. FIGS. 7-9 illustrate one process of installing the slider on the fastener 12. Although the tracks 22, 24 behind the slider 10 in FIGS. 7 and 8 (e.g., to the right of reference numeral 50) are shown as being open, the spacing between the tracks 22, 24 can be adjusted to facilitate installation of the slider 10. For example, the tracks 22, 24 behind the slider 10 can be adjusted to be partially closed.

Referring back to FIGS. 1-5, the slider 10 has an opening end (located near separating finger 52) and a closing end (located near separating finger 54), the slider 10 is wider at the opening end to allow separation of the first and second profiles 24, 28. The slider 10 is sufficiently narrow at the closing end to press the first and second profiles 24, 28 into an interlocking relationship as the slider 10 is moved in the closing direction.

To indicate the direction to move the slider 10 to close the bag, an optional arrow 40 may be formed in the slider 10 as shown in FIG. 1. The arrow 40 may be formed on the top of the slider 10 by a molding process. If the arrow 40 is used, then it is desirable for the depth of the arrow 40 to be minimized. By minimizing the depth of the arrow 40 and any other potential coring of the slider top, the rigidity of the slider is increased, which results in improved slider-top retention. The term "slider-top retention" refers to the ability of the slider to prevent or inhibit being removed in a direction generally perpendicular with the movement of the slider between an open and closed position. The term "end retention" refers to the ability of the slider to prevent or inhibit being removed in a direction generally parallel with the movement of the slider between an open and closed position.

It is desirable to have the top of the slider that is substantially free of coring. As used herein, the term coring includes coring during molding as understood by those of ordinary skill in the art, as well as removal of material after molding. For example, it is desirable to have the top of the slider be formed with coring having a depth less than about 0.035 inches, more desirable for the coring to have a depth less than about 0.030 inches, and still more desirable for the coring to have a depth less than about 0.020 inches.

The slider 10 may be formed from suitable polymeric material such as, for example, nylon, polypropylene, polyethylene, polystyrene, polyethylene terephthalate (PET), Delrin, or ABS. The slider may be formed by injection molding, thermoforming, compression molding, extrusion, or machining or patterned material deposition. The slider 10 is particularly suited for use with profiled polymeric reclosable fasteners or zippers and thermoplastic bags such as shown in FIGS. 7-10.

The fastener 12 typically comprises one or more polymeric resins. The fastener may be comprised of polyolefins including, but not limited to, polyethylene, polypropylene, or combinations thereof.

Referring back to FIGS. 1-5, the foldable slider 10 comprises an inverted generally U-shaped member that includes a transverse support member or body 50 from which a plurality of separating fingers 52, 54 depends therefrom. A top, outer surface of the support member 50 may include the optional arrow 40 shown in FIG. 1. The body 50 also includes two integral depending legs 56, 58 and two hinged "wings" 60, 62. The wings 60, 62 also have respective wing shoulders 68, 70 (see FIGS. 5*a,b*).

Figure 3:
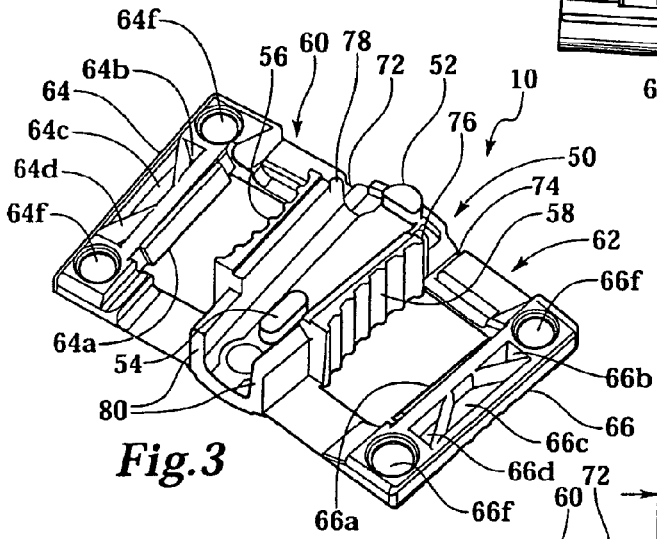
FIG. 3 is a bottom perspective view of the slider of FIG. 1 in the open position.
Figure 4:
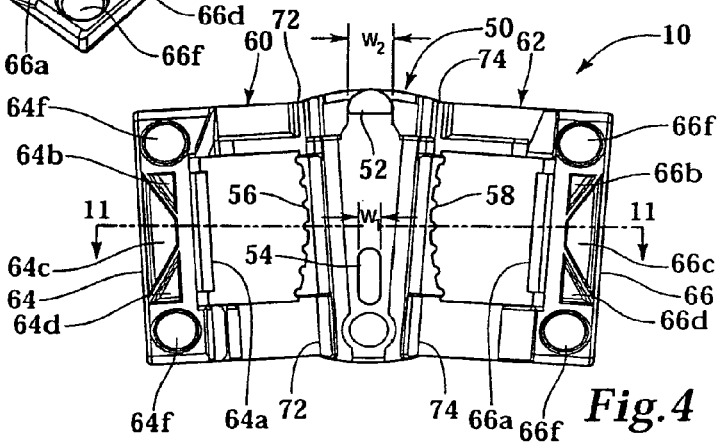
FIG. 4 is a bottom plan view of the slider of FIG. 1 in the open position.

The separating finger 52 is wider than the separating finger 54 as shown in FIGS. 3 and 4. The separating finger 52 is shown as a generally half-moon shape, while the separating finger 54 is shown as an elongated oval shape. The separating finger 52 may be circular shaped, an elongated oval shape, or elliptically shaped. The separating finger 54 may also be circular shaped, elliptically shaped, tadpole, or a generally half-moon shape. The separating fingers 52, 54 generally have a surface or edge that is blunt (i.e., rounded).

The separating finger 54 as shown in FIG. 4 has a width W1 that is generally greater than about 0.02 inch and, more specifically, the width W1 is typically greater than about 0.045 inch. The width W1 is generally from about 0.02 to about 0.05 inch. Similarly, the separating finger 52 as shown in FIG. 4 has a width W2 that is generally greater than about 0.08 inch and, more specifically, the width W2 is typically greater than about 0.09 inch. The width W2 is generally from about 0.085 to about 0.11 inch. The distance between the first and second separating fingers 52, 54 is desirably optimized to equal the tracks' "natural open-to-close shape," as that term is understood by those of ordinary skill in the art.

The shape and width of the separating finger 52 assists in opening the top of the fastener and improving the end strength retention of the slider. The shape and width of the separating finger 54 assists in improving the end strength retention of the slider and also assists in placing the slider onto the track.

It is desirable to have at least two separating fingers, which reduces the cycle time by allowing additional ejector pin(s) to be used between the separating fingers. The cycle time is especially reduced by creating a larger generally flat surface between the separating fingers that allows the use of larger, flatter ejector pins. It is also desirable to have distinct separating fingers to reduce the cost of material and the mold cycle time by reducing the cooling time.

The separating fingers 52, 54 interact with the first and second portions 32, 34 (FIGS. 7-9) of the fastener 12 to lock and unlock the first and second profiles 24, 28 of the fastener 12. The separating finger 52 in cooperation with the shoulders 68, 70 spread the first and second portions 32, 34. The spread first and second portions 32, 34 separate the first and second profiles 24, 28, thereby opening the fastener 12 as the slider 10 is moved.

To close the fastener 12, the slider 10 is moved in the reverse direction and the second separating finger 54 cooperates with the shoulders 68, 70 and the legs 56, 58 and wings 60, 62 of the slider 10 to bring the first and second portions 32, 34 together. The first and second portions 32, 34 when brought together lock the first and second profiles 24, 28. To close the fastener 12 completely, at least the separating finger 52 is removed from between the first and second portions 32, 34 of the fastener 12.

To assist in grasping the slider, the legs 56, 58 and portions of the wings 60, 62 form gripper ribs using hills and valleys. This is shown in FIG. 1, for example, with a plurality of hills 58*c*, 62*c*, and a plurality of valleys 58*d*, 62*d*. The shape of the slider 10 assists in fitting the natural shape created between a user's index finger and thumb. The gripper ribs formed by the hills and valleys or other suitable protrusions or tactilely enhanced surfaces interact with the user's finger and thumb to increase friction. By improving the friction between the gripper ribs and the user's finger and thumb, the slider is more easily grasped in less than ideal circumstances such as wet and oily conditions.

The lower ends of legs 56, 58 are provided with respective engaging shoulders 56*a*, 58*a* (see FIG. 11) and respective surfaces 56*b*, 58*b* adjacent to the respective engaging shoulders 56*a*, 58*a*.

The body 50 also includes a molded rear window 80 (see FIG. 3) that assists in closing the track. The molded rear window 80 increases the rigidity of the slider and assists in improving the slider-top and end retention strength. Thus, by having the molded rear window 80, the slider is further inhibited or prevented from being removed from the track.

The wings 60, 62 have a respective cross piece 64, 66 that form respective latches 64*a*, 66*a*. The latches 64*a*, 66*a* are desirably sloped and solid ramps. To increase the latch strength, each of the latches 64*a*, 66*a* substantially extends across the full length of the respective legs 56, 58. The latches 64*a*, 66*a* may extend the full length of the respective legs 56, 58. By having the latches 64*a*, 64*b* substantially extend across the full length of the respective legs 56, 58, wing deflection is reduced, which increases end retention of the slider. It is also believed that the latches 64*a*, 66*a* substantially extending across the full length of the respective legs 56, 58 also increase the top retention of the slider. Thus, it is more difficult for the slider to be removed by having a latch extending substantially across the full length of the respective legs 56, 58.

Portions of the inner surface of the cross pieces 64, 66 form respective plurality of cored-out regions 64*b*-64*d* and 66*b*-66*d*. The cored-out regions reduce the weight of the slider, which reduces the cost in forming the slider. To assist in maintaining the strength of the slider, the cored-out regions 64*b*-64*d* and 66*b*-66*d* desirably form a plurality of triangles in the form of a truss. If desired, the cored-out regions 64*b*-64*d* and 66*b*-66*d* can form other shapes that maintain the strength of the slider and enhance the latching ability of latches 64*a*, 64*b*. For example, in some embodiments, the cored-out regions 64*b*-64*d* and 66*b*-66*d* can form one or more ribbed shapes.

By having cored-out regions, the cycle time of forming the slider is also reduced because cooling occurs faster. By coring the cross pieces 64, 66, the potential for shrinkage is reduced.

The cross pieces 64, 66 also form respective cored-out wing eject pads 64*f*, 66*f*. The cored-out wing eject pads 64*f*, 66*f* are shown as being generally cylindrical in shape. It is contemplated that the wing eject pads may be of other shapes. The wing eject pads 64*f*, 66*f* may be formed by having wing eject pads mold the slider when the eject pins move, but the sleeves remain in place.

As discussed above, the shoulders 68, 70 cooperate with the first separating finger 52 to assist in opening and closing the fastener. The shoulders 68, 70 also engage the fastener 12 to inhibit or prevent the slider 10 from being lifted off the profile edges while the slider 10 straddles the fastener 12. Specifically, the shoulders 68, 70 engage with lower surfaces of the profiles to inhibit or prevent (a) the slider from being pulled off in a direction perpendicular to the sliding motion, and (b) the slider from being removed from the force required to open the profiles.

Referring specifically to FIGS. 3 and 4, the wings 60, 62 are connected to the body 50 via respective hinge structures 72, 74 located on opposite sides of the body 50. The hinge structures 72, 74 are relatively thin sections of polymeric material as compared to the wall thicknesses of the wings 60, 62 and the flexibility of the polymeric material makes possible the use of the integral hinge structures 72, 74, which are sometimes referred to as "living" hinges. The wings 60, 62 form central openings to receive the respective legs 56, 58 when the wings 60, 62 are folded down to the closed sidewall position, as will be described below.

FIGS. 7-9 depict the slider 10 undergoing assembly on a bag according to one process. The slider 10 is mounted on the first and second tracks 20, 22 of the fastener 12 in such a way that the separating fingers 52, 54 are between the first and second profiles 24, 28 of the respective tracks 20, 22. The depending legs 56, 58 are positioned on the outside of the tracks 20, 22 in such a way that the tracks 20, 22 of the fastener 12 separate the plurality of separating fingers 52, 54 from the respective depending legs 56, 58. The wings 60, 62 are then rotated downward toward the bottom of the bag with the "living" hinges acting as the axis of rotation. FIG. 9 shows the slider 10 in an assembled condition with the wings 60, 62 being folded down to their closed sidewall state.

To prevent or inhibit the wings 60, 62 from continuing past the latched hinge rotational point, the body 50 includes wing closing stops 76, 78. The wing closing stops 76, 78 may be molded in the legs 56, 58. The wing closing stops 76, 78 limit or stop the wings 60, 62 from continuing past the latched hinge rotational point. This limits potential pinching of the track when the user squeezes the slider 10 with too much force. By reducing the pinching on the track, the slider 10 moves along the track more easily.

Figure 11:
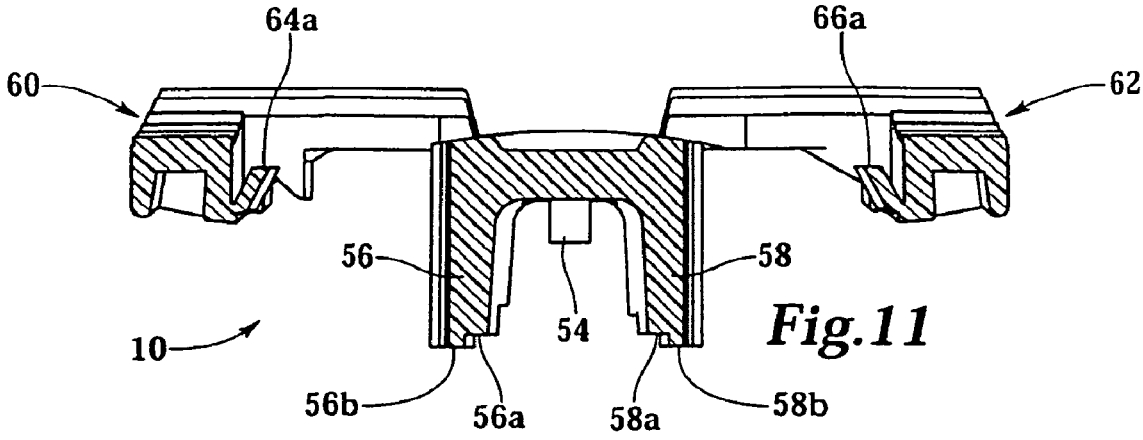
FIG. 11 is a cross-sectional view of the slider of FIG. 1 taken generally along the line 11-11 of FIG. 4.
Figure 12:
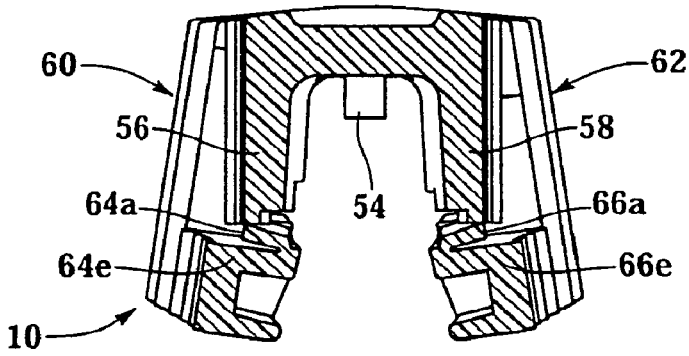
FIG. 12 is a cross-sectional view of the slider of FIG. 11 just before being in the closed position.

When the wings 60, 62 are folded down from their open position to their closed sidewall position, the wings 60, 62 are held in place by a compression-type latch. FIG. 11 depicts a cross-sectional view taken generally along line 11-11 shown in FIG. 4. FIG. 11 shows the slider 10 in an open position. FIG. 12 shows the slider 10 just before being in the closed position, while FIG. 13 shows the slider 10 in the closed position.

Figure 13:
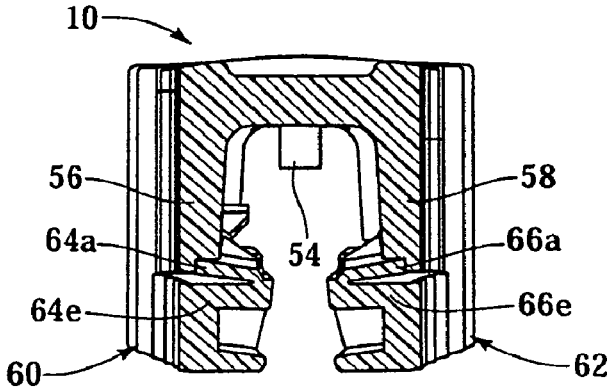
FIG. 13 is a cross-sectional view of the slider of FIG. 11 in the closed position.

As shown in FIGS. 11-13, when the wing 60 is rotated to the closed sidewall position, the latch 64*a* comes into contact with the surface 56*b* adjacent to the engaging shoulder 56*a*. When the wing 60 is moved toward the closed sidewall position, the surface 56*b* exerts a downward force on the latch 64*a* as shown in FIG. 12. This causes the sloped latch 64*a* to flex or depress. In this embodiment, an upper edge 64*e* of the wing 60 does not flex or depress. The latch 64*a* remains depressed until the leg 56 has completely passed thereover. Then, the latch 64*a* returns to its original shape that forces engagement with the engaging shoulder 56*a* shown in FIGS. 11 and 12, thereby locking the wing 60 and leg 56 into the closed sidewall position.

This compression-type latch offers many advantages. It allows for easier installation of the slider 10 and increases the difficulty in removing the slider from the bag. The latch 64*a*, when depressed, acts similar to a spring in compression and, once released, is forced upward into a locked condition with the engaging shoulder 56*a* of leg 56. As the wing 60 is being latched, the surface 56*b* depresses the latch 64*a*. When attempting to disengage the wing 60 from the leg 56, however, the direction in which the force acts is unable to depress the latch 64*a*; rather, it forces the leg 56 more strongly into engagement with the wing 60. This increases the difficulty in disassembling the slider.

Similarly, the wing 62 has the latch 66*a*, cross piece 66, shown in FIG. 12, which allow the latch 66*a* to engage the shoulder 58*a* of the leg 58. This provides a compression-type latch to lock wing 62 in place with leg 58. All of which functions in the same manner as for the wing 60 described above.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

The invention claimed is:

1. A method of installing a foldable plastic slider onto a reclosable plastic bag having opposing body panels attached to each other along a pair of opposing sides and a bottom bridging the sides, a mouth formed opposite said bottom, and a reclosable fastener extending along said mouth, said fastener including a first track with a first profile and a second track with a second profile, said first and second profiles being releasably engageable to each other, said plastic slider being slidably mounted to said fastener, said method comprising:

providing a foldable plastic slider, the foldable plastic slider including a transverse support member including first and second opposing sides, an interior surface, and an outer surface;

first and second legs depending from said respective first and second opposing sides of said support member and extending downward from the interior surface of the support member;

a first separating finger extending from said interior surface of said support member, said first separating finger adapted to open the first and second profiles;

a second separating finger extending from said interior surface of said support member; and first and second wings hingedly attached to said respective first and second opposing sides, said first and second wings having respective first and second openings for receiving said respective first and second legs, said first and second wings having respective first and second cross pieces, each of said cross pieces including a main body member and a latch, said first and second wings being folded relative to said support member and each of said latches engaging one of said respective legs to install said slider on said fastener;

placing said transverse support member on said plastic fastener with said first and second separating fingers between said first and second tracks and said first and second depending legs outside said respective first and second tracks such that said respective first and second tracks separate said first and second separating fingers from said respective first and second legs;

rotating said first and second wings downward toward a bottom of said reclosable bag until each of said latches engages one of said respective legs; and pressing said first and second wings until each of said latches snaps into engagement with one of said respective shoulders of said respective leg.

2. The method of claim 1, further comprising forming end stops in the first and second wings which prevent or inhibit said first and second wings from moving past a latched hinge rotational point formed after each of said latches engages a respective one of said legs.

3. The method of claim 1, further comprising forming at least one of said first and second separating fingers to include a rounded surface.

4. The method of claim 1, further comprising forming tactilely enhanced surfaces in each of said first and second legs to assist in grasping the slider.

5. The method of claim 1, wherein each of said main body members is cored-out.

6. The method of claim 5, wherein each of said main body members has a plurality of cored-out regions on an interior of the respective cross piece such that said plurality of cored-out regions are at least partially hidden when said slider is installed on a fastener.

7. The method of claim 1, wherein the slider is made of at least one material from a group consisting of nylon, polypropylene, polyethylene, polystyrene, polyethylene terephthalate, Delrin, or ABS.

8. The method of claim 1, wherein the slider is formed by injection molding.

9. The method of claim 1, wherein the slider is formed by thermoforming.

10. The method of claim 1, wherein the slider is formed by compression molding.

11. The method of claim 1, wherein the slider is formed by extrusion.

12. The method of claim 1, wherein the slider is formed by machining a patterned material deposition.

13. A method of installing a foldable plastic slider onto a reclosable plastic bag having opposing body panels attached to each other along a pair of opposing sides and a bottom bridging the sides, a mouth formed opposite said bottom, and a reclosable fastener extending along said mouth, said fastener including a first track with a first profile and a second track with a second profile, said first and second profiles being releasably engageable to each other, said plastic slider being slidably mounted to said fastener, said method comprising:

providing a foldable plastic slider, the foldable plastic slider including a transverse support member including first and second opposing sides, an interior surface, and an outer surface;

first and second legs depending from said respective first and second opposing sides of said support member and extending downward from the interior surface of the support member;

a first separating finger extending from said interior surface of said support member, said first separating finger having an exposed surface about its periphery and adapted to open the first and second profiles;

a second separating finger extending from said interior surface of said support member, said second separating finger having an exposed surface about its periphery; and first and second wings hingedly attached to said respective first and second opposing sides, said first and second wings having respective first and second openings for receiving said respective first and second legs, said first and second wings having respective first and second cross pieces, each of said cross pieces including a main body member and a latch, said first and second wings being folded relative to said support member and each of said latches engaging one of said respective legs to install said slider on said fastener;

placing said transverse support member on said plastic fastener with said first and second separating fingers between said first and second tracks and said first and second depending legs outside said respective first and second tracks such that said respective first and second tracks separate said first and second separating fingers from said respective first and second legs;

rotating said first and second wings downward toward a bottom of said redo sable bag until each of said latches engages one of said respective legs; and pressing said first and second wings until each of said latches snaps into engagement with one of said respective shoulders of said respective leg.

14. The method of claim 13, further comprising forming a shoulder portion in an edge of each of said legs for engaging the respective latch.

15. The method of claim 13, wherein said first and second legs form respective wing closing stops which prevent or inhibit said first and second wings from moving past a latched hinge rotational point formed after each of said latches engages a respective one of said legs.

16. The method of claim 13, wherein said transverse support member further includes a molded rear window with an outer surface located adjacent to said first and second legs, said outer surface of said molded rear window being adapted to contact said first and second legs after said slider is installed on said fastener.

17. The method of claim 13, wherein the slider is made of at least one material from a group consisting of nylon, polypropylene, polyethylene, polystyrene, polyethylene terephthalate, Deirln, or ABS.

18. The method of claim 13, wherein the slider is formed by injection molding.

19. The method of claim 13, wherein the slider is formed by thermoforming.

20. The method of claim 13, wherein the slider is formed by compression molding.

* * * * *